US009790680B2

(12) United States Patent
Rotter

(10) Patent No.: US 9,790,680 B2
(45) Date of Patent: Oct. 17, 2017

(54) SHEAR TIE SYSTEM FOR VENTED ROOF RIDGE

(71) Applicant: Martin J. Rotter, Glenside, PA (US)

(72) Inventor: Martin J. Rotter, Glenside, PA (US)

( * ) Notice: Subject to any disclaimer, the term of this patent is extended or adjusted under 35 U.S.C. 154(b) by 14 days.

(21) Appl. No.: 15/439,367

(22) Filed: Feb. 22, 2017

(65) Prior Publication Data

US 2017/0159315 A1 Jun. 8, 2017

Related U.S. Application Data

(62) Division of application No. 15/021,758, filed as application No. PCT/US2015/021456 on Mar. 19, 2015.

(60) Provisional application No. 61/955,275, filed on Mar. 19, 2014.

(51) Int. Cl.
*E04D 12/00* (2006.01)
*E04B 1/98* (2006.01)

(52) U.S. Cl.
CPC ..... *E04B 1/98* (2013.01); *E04D 12/008* (2013.01)

(58) Field of Classification Search
CPC . E04B 1/98; E04B 1/2608; E04B 1/94; E04D 12/00; E04D 12/008; E04D 13/0325; E04D 13/174; E04D 13/00
See application file for complete search history.

(56) References Cited

U.S. PATENT DOCUMENTS 644,176 A 2/1900 Johnston
1,204,956 A * 11/1916 Day ..... E04C 3/02 52/695
1,204,959 A 11/1916 Day
1,656,741 A 1/1928 Lane
1,945,925 A 2/1934 Stiefel
3,303,773 A * 2/1967 Smith ..... E04D 13/174 454/365
3,333,875 A 8/1967 Tracy
(Continued)

FOREIGN PATENT DOCUMENTS

CH 686686 A5 5/1996
EP 1 333 131 B1 3/2006
(Continued)

OTHER PUBLICATIONS

"Design Solutions for Wood-Frame Multi-Story Buildings—Resisting Uplift and Lateral Forces" Simpson Strong-Tie [online]. Aug. 2007. Retrieved on Nov. 17, 2015. Retrieved from the internet: <http://www.strongtie.com/ftp/articles/woodframemultistory-article.pdf>; figure 3; p. 6.
(Continued)

*Primary Examiner* — Paola Agudelo
(74) *Attorney, Agent, or Firm* — Volpe and Koenig, P.C.

(57) ABSTRACT

A roof system which includes a shear tie for the ridge beam is provided. This system is for use in connection with tile roofing systems in which a ridge vent for ventilation is also provided, but can be used with other roof systems. Sheathing is located on the rafters and a gap or slot is provided between the top edge of the sheathing and the ridge beam that extends along a majority of the ridge beam in order to provide an air flow path for building ventilation. A shear tie strap is connected to the ridge beam and to the sheathing on either side of the ridge beam. A shear tie strap is also provided.

11 Claims, 7 Drawing Sheets

(56) References Cited

U.S. PATENT DOCUMENTS

| | | | | |
|---|---|---|---|---|
| 3,423,898 | A | 1/1969 | Tracy et al. | |
| 3,481,635 | A | 12/1969 | Tracy | |
| 4,498,801 | A | 2/1985 | Gilb | |
| 4,794,746 | A | 1/1989 | Ramer | |
| 4,893,961 | A | 1/1990 | O'Sullivan et al. | |
| 5,568,706 | A | 10/1996 | Gerhing et al. | |
| 5,797,694 | A | 8/1998 | Breivik | |
| 5,800,232 | A | 9/1998 | Miyazaki | |
| 6,240,695 | B1 | 6/2001 | Karalic et al. | |
| 6,295,781 | B1 | 10/2001 | Thompson | |
| 6,332,299 | B1 | 12/2001 | Stewart, III | |
| 6,840,020 | B2 | 1/2005 | Leek et al. | |
| 6,892,504 | B1 | 5/2005 | diGirolamo et al. | |
| 7,134,252 | B2 | 11/2006 | Thompson | |
| 7,381,058 | B1 | 6/2008 | Hayes, Sr. | |
| 7,503,148 | B2 | 3/2009 | Lin | |
| 8,966,857 | B2 | 3/2015 | Pope et al. | |
| 9,677,272 | B2 | 6/2017 | Vanker et al. | |
| 2004/0107653 | A1 | 6/2004 | Collie | |
| 2005/0076607 | A1 | 4/2005 | Fennell, Jr. | |
| 2005/0202779 | A1 | 9/2005 | Smith | |
| 2007/0054612 | A1* | 3/2007 | Ehrman | F24F 7/02 454/365 |
| 2008/0318516 | A1 | 12/2008 | Rotter | |
| 2010/0162783 | A1 | 7/2010 | Lin | |
| 2011/0302852 | A1* | 12/2011 | Grubka | E04D 1/20 52/43 |
| 2012/0047828 | A1* | 3/2012 | Bahn | E04D 13/174 52/199 |
| 2012/0047841 | A1 | 3/2012 | Fyfe et al. | |
| 2012/0272608 | A1 | 11/2012 | Groenesteyn | |
| 2012/0297724 | A1 | 11/2012 | Pope et al. | |
| 2014/0000208 | A1 | 1/2014 | Vanker et al. | |
| 2014/0179220 | A1* | 6/2014 | Railkar | E04D 3/30 454/365 |

FOREIGN PATENT DOCUMENTS

| | | | |
|---|---|---|---|
| GB | 2 186 606 | A | 8/1987 |
| GB | 2 376 960 | A | 12/2002 |
| JP | 2000-145026 | A | 5/2000 |
| WO | 2015/143149 | A1 | 9/2015 |

OTHER PUBLICATIONS

"Retrofit Information" World Housing Encyclopedia [online]. Jan. 25, 2015. Retrieved on Nov. 18, 2015. Retrieved from the internet: <https://web .archive .org/web/20 150 125130453/http:/ldb. world-housing. net netlbuilding/154>; entire document.

Wind Brace Builder Bill Jul. 2, 2013 Source: https://web.archive.org/web/20130702090711/http://www.builderbill-diy-help.com/wind-brace.html Date Accessed: Dec. 21, 2014.

The Shed Roof Begins DIY House Oct. 15, 2011 Source: http://bluemount.terravista.com.au/the-shed-roof-begins Date Accessed: Dec. 18, 2014.

Zinc Plated Bracket/Cross Bars Rands Creative Creations Harold Rand Enterprises Dec. 16, 2010 Source: http://www.rcchre.com/CatPages/ADL/Hardware/H070_.html Date Accessed: Dec. 21, 2014.

GT2Z/GT6Z/GTFZ Gazebo Connectors Simpson Strong-Tie Nov. 9, 2013 Source: https://web.archive.org/web/20131109034409/http://www.strongtie.com/products/DIY/GT2-GT6-GTF.html Date Accessed: Dec. 21, 2014.

Straps & Ties Simpson String-Tie Dec. 12, 2013 Source: http://www.strongtie.com/ftp/catalogs/c-2013/C-2013-p172-p174.pdf.

Bracing systems SteelConstruction.info Nov. 22, 2013 Source: https://web.archive.org/web/20131122211449/http://www.steelconstruction.info/Bracing_systems Date Accessed: Dec. 21, 2014.

* cited by examiner

SHEAR TIE SYSTEM FOR VENTED ROOF RIDGE

CROSS REFERENCE TO RELATED APPLICATION

This application is a divisional of U.S. patent application Ser. No. 15/021,758, which is a 35 USC §371 national stage application of PCT/US2015/021456, which was filed Mar. 19, 2015 and claims priority to U.S. Provisional Patent Application No. 61/955,275, filed Mar. 19, 2014, all of which are incorporated herein by reference as if fully set forth.

BACKGROUND

The invention is related to the general field of roof construction systems. Particularly, the invention relates to hurricane and earthquake resistant building structures.

It has been known in the field of building construction to use metal ties to attach walls and floors to the building foundation in order to hold the building structure stable during hurricanes and/or earthquakes. Such reinforcements are typically formed of metal strapping material which includes pre-punched holes used for fastening the straps to the foundation and the structure located above. Construction systems intended for hurricane prone or earthquake zones typically require that these metal ties be used in order to connect all of the frame components to the foundation. It is also known to use such metal strapping reinforcements to tie the bottoms of the roof rafters to the tops of the walls. However, currently there is no system which includes tying in the roof ridge, particularly in applications where a ridge vent is located along the roof ridge resulting in a space or gap between the plywood sheathing located on the rafters and the ridge beam.

SUMMARY

The present invention provides a roof system which includes a shear tie for the ridge beam. This system is particularly preferred for use in connection with tile roofing systems in which a ridge vent for ventilation is also provided, but can be used with other roof systems. The roof ridge vent can be for example as disclosed in U.S. 2008/0318516, which is invented by the same inventor as the present application. The roof system includes a ridge beam which is supported via rafters. Sheathing is located on the rafters and a gap or slot is provided between the top edge of the sheathing and the ridge beam that extends along a majority of the ridge beam in order to provide an air flow path for building ventilation. A shear tie strap is connected to the ridge beam and to the sheathing on either side of the ridge beam. The shear tie strap includes two cross straps that extend at an acute angle to the ridge beam which are connected at the down slope ends thereof to nailer strips. A center nailer strip is also provided for attachment to the ridge beam. The shear tie strap preferably has a width that is adapted to a spacing between adjacent rafters on the roof. A preferred width is 17.5 inches or 25.5 inches for use with rafters on 16 inch or 24 inch centers. However, other widths could be used. If necessary, blocking can be added between adjacent rafters for attachment of the nailer strips to provide sufficient shear force transfer area to the roof structure. Additionally, openings are located through the shear tie strap on each side of the center nailer strip in order to allow the ventilation areas provided by the gaps or slots located on either side of the ridge beam to remain as open as possible.

In one preferred application, a ridge pole extension is attached on top of the shear tie strap to the ridge beam in order to support the cap tiles.

In another aspect of the invention, purlins are attached along the upper edge of the sheathing over the shear tie straps in order to anchor the upper row of roofing tiles to the roof surface.

The shear tie straps can be located on each adjacent pair of rafters or can be spaced apart, depending upon the particular loading requirements for the roof system.

In another aspect, the shear tie strap can extend over a ridge beam that extends above the rafters in order to provide direct anchoring of the cap tiles to the ridge beam.

In another aspect, the shear tie strap comprises two sheet metal bodies which are crossed at an intermediate region, one overlapping the other, the intermediate region forming at least part of a nailer strip to the ridge beam.

In a preferred embodiment, holes are punched through the shear tie strap in various positions for installation of nails or other fasteners to secure the shear tie strap to the rafters and/or ridge beam.

In a preferred embodiment, the shear tie strap is a punched sheet metal part made from 20 gauge steel.

In an aspect, the invention relates to a shear tie system for a vented roof ridge. The shear tie system comprises a ridge beam which is supported via rafters and sheathing located on the rafters, and a gap or slot is provided between a top edge of the sheathing and the ridge beam that extends along a majority of the ridge beam in order to provide an air flow path for building ventilation. A shear tie strap is connected to the ridge beam, the sheathing and the rafters on either side of the ridge beam. The shear tie strap includes a center nailer strip for attachment to the ridge beam, and two cross straps that extend at an acute angle to the ridge beam and include at down slope ends thereof nailer strips. The shear tip strap has a center where the two cross straps cross or intersect, a first longitudinal end including the respective nailer strips displaced from the center of the shear tie strap in a first direction toward a first longitudinal end of the ridge beam, and a second longitudinal end including the respective nailer strips displaced from the center of the shear tie strap in a second direction toward a second end of the ridge beam and opposite to the first direction.

In this aspect, preferred but non-limiting embodiments may include the following. The shear tie strap may have a width that is adapted to a spacing between adjacent rafters on the roof. The shear tie strap may comprises a first sheet metal body and a second sheet metal body, each comprising one of the two cross straps, wherein the two cross straps overlap in an intermediate region such that the overlapping intermediate regions form at least part of the center nailer strip. The shear tie strap may further comprises a first connecting strap that extends over the ridge beam and connects the cross straps extending toward the first longitudinal end of the shear tie strap. The shear tie strap may further comprise a second connecting strap that extends over the ridge beam and connects the cross straps extending toward the second longitudinal end of the shear tie strap. The first connecting strap may be associated with the respective nailer strips on each cross strap at the first longitudinal end, and the second connecting strap may be associated with the respective nailer strips on each cross strap at the second longitudinal end. The first connecting strap may include nailer strips and the second connecting strap may include nailer strips. The nailer strips at down slope ends of the two cross straps may be integral with the two cross straps.

In an aspect, the invention relates to a shear tie strap. The shear tie strap comprises a first sheet metal body including a cross strap having a first intermediate region; and a second sheet metal body including a cross strap having a second intermediate region. The first intermediate region and the second intermediate region cross to form at least part of a center nailer strip.

In this aspect, preferred but non-limiting embodiments may include the following. The first sheet metal body and the second sheet metal body may be integral with one another. The first sheet metal body and the second sheet metal body may be separate and the first intermediate region and the second intermediate region may overlap to form at least part of a center nailer strip. The shear tie strap may have a width that is adapted to a spacing between adjacent rafters on a roof. The spacing may be 16 inches on center. The spacing may be 24 inches on center. The first sheet metal body may have a first longitudinal end and a second longitudinal end and further include a nailer strip at the first longitudinal end and a nailer strip and the second longitudinal end. The second sheet metal body may have a first longitudinal end and a second longitudinal end and further include a nailer strip at the first longitudinal end and a nailer strip and the second longitudinal end. The first longitudinal end of the first sheet metal body and the first longitudinal end of the second sheet metal body may define a first longitudinal end of the shear tie strap displaced from the center nailer strip in a first direction, and the second longitudinal end of the first sheet metal body and the second longitudinal end of the second sheet metal body may define a second longitudinal end of the shear tie strap displaced from the center nailer strip in a second direction opposite to the first direction. The shear tie strap may further comprise a first connecting strap adapted to extend over a ridge beam and connect the first sheet metal body and the second sheet metal body toward or at the first longitudinal end of the shear tie strap. The shear tie strap may further comprise a second connecting strap adapted to extend over the ridge beam and connect the first sheet metal body and the second sheet metal body toward or at the second longitudinal end of the shear tie strap. The first connecting strap may be associated with the respective nailer strips on the respective first longitudinal ends of the first sheet metal body and the second sheet metal body. The second connecting strap may be associated with the respective nailer strips on the respective second longitudinal ends of the first sheet metal body and the second sheet metal body. The first connecting strap may include nailer strips and the second connecting strap may include nailer strips. At least one of the nailer strip at first longitudinal end of the first sheet metal body, the nailer strip at the second longitudinal end of the first sheet metal body, the nailer strip at the first longitudinal end of the second sheet metal body, or the nailer strip at the second longitudinal end of the second sheet metal body may be integral with the respective sheet metal body.

BRIEF DESCRIPTION OF THE DRAWINGS

The present invention will be explained in more detail in connection with the drawings in which presently preferred embodiments of the invention are shown. In the drawings.

DETAILED DESCRIPTION OF THE PREFERRED EMBODIMENTS

Figure 1:
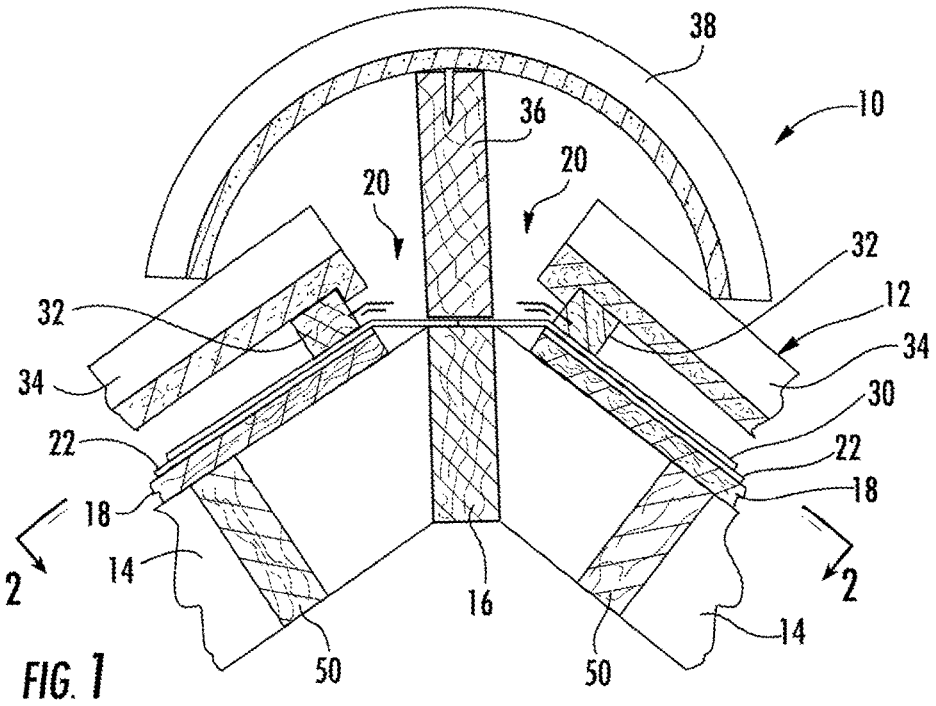
FIG. 1 is a cross-sectional view of a first embodiment of a shear tie system for a vented roof ridge arrangement with a shear tie strap according to the present invention.

Certain terminology is used in the following description for convenience only and is not considered limiting. Words such as "front," "back," "top," and "bottom" designate directions in the drawings to which reference is made. This terminology includes the words specifically noted above, derivatives thereof, and words of similar import. Additionally, the terms "a" and "one" are defined as including one or more of the referenced item unless specifically noted.

Preferred embodiments of the present invention will be described with reference to the drawing figures wherein like numerals represent like elements throughout.

Figure 2:
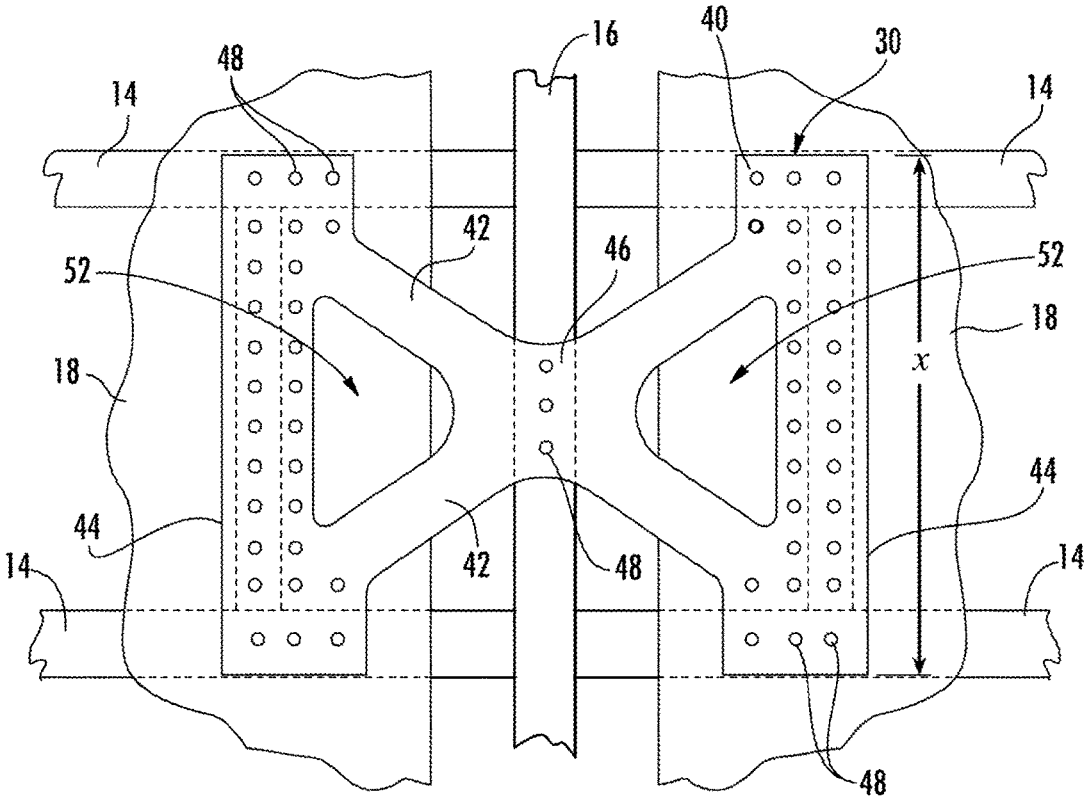
FIG. 2 is a top view taken generally along lines 2-2 in FIG. 1 showing the shear tie strap in position prior to the installation of tiles on the roof.

Referring to FIGS. 1 and 2, a tile roof having a shear tie system for connecting the rafters to the roof ridge beam, designated overall as system 10, is shown. Here, the system 10 includes the roof 12 having rafters 14 which support the ridge beam 16, which runs along the peak of the roof. Sheathing 18 is applied to the rafters 14 with a gap or slot 20 being provided between the ridge beam 16 and the up-slope edge of the sheathing 18. This gap or slot 20 provides for airflow from the interior of the roof structure in order to ventilate the underside of the roof. This can be used in connection with a roof ridge vent, for example, as provided by U.S. 2008/0318516, which is incorporated herein by reference as if fully set forth.

Still with reference to FIG. 1, preferably a roofing felt 22 is applied to the sheathing 18. A shear tie strap 30 in accordance with the invention is then installed over the peak of the roof and is connected to the ridge beam 16 as well as the sheathing 18 and rafters 14 of either side of the ridge beam 16. The shear tie strap 30 preferably is formed of a stamped sheet metal body 40 and includes cross straps 42 in order to transfer shear forces across the ridge beam 16 and to the rafters 14 on the opposite side. Nailer strips 44 are provided on both downslope ends of these cross straps 42, and a center nailer strip 46 is provided with an enlarged area for connection to the ridge beam 16. Preferably holes 48 are pre-formed in the stamped sheet metal body 40 for the shear tie strap 30. These can be punched at the same time that the sheet metal body 40 is punched or can be drilled or punched afterwards in a separate step. While a representative pattern for these preformed holes 48 is shown, those skilled in the art will recognize that other patterns can be used.

As shown in FIG. 2, preferably the shear tie strap 30 has a width X that is designed to extend between adjacent rafters 14. In a preferred embodiment, this dimension is preferably 17.5 inches or 25.5 inches in order to allow the shear tie strap 30 to span adjacent rafters 14 typically located at 16 inches on center or 24 inches on center. However, those skilled in the art will recognize that other widths can be provided depending upon the local building construction codes in order to accommodate the spacing between rafters 14.

The shear tie strap 30 is installed using nails or screws between adjacent rafters 14 and is connected to the ridge beam 16 as well. Depending upon the shear loads anticipated due to either earthquake or hurricane conditions, the shear tie straps 30 can be located between each pair of adjacent rafters 14 or can be spaced apart further, as required.

In the preferred embodiment, the shear tie strap 30 is punched from 20 gauge sheet metal. However, other thicknesses of sheet metal can be utilized, depending upon the loads required for the particular application.

As shown in FIGS. 1 and 2, blocking 50 can be installed between the adjacent rafters 14 in a position aligned with the nailer strip ends 44 of the shear tie strap 30. Preferably, these are located approximately 7-10 inches down slope from the ridge beam 16. However, depending upon the particular application, these can be omitted or may be provided with different spacing.

The shear tie strap 30 is designed for use in connection with a ventilated roof ridge and accordingly, openings 52 are provided in order to reduce the blocked airflow area through the gaps or slots 20 caused by the shear tie strap 30.

To complete the roof construction after installation of the shear tie strap 30, purlins 32 can be installed in order to support the upper edges of the roof tiles 34, as shown in FIG. 1. A ridge pole extension 36 can then be attached over the to the ridge beam 16, over the shear tie strap 30, to allow fastening of the cap tiles 38 along the roof peak to the ridge pole extension 36.

Figure 3:
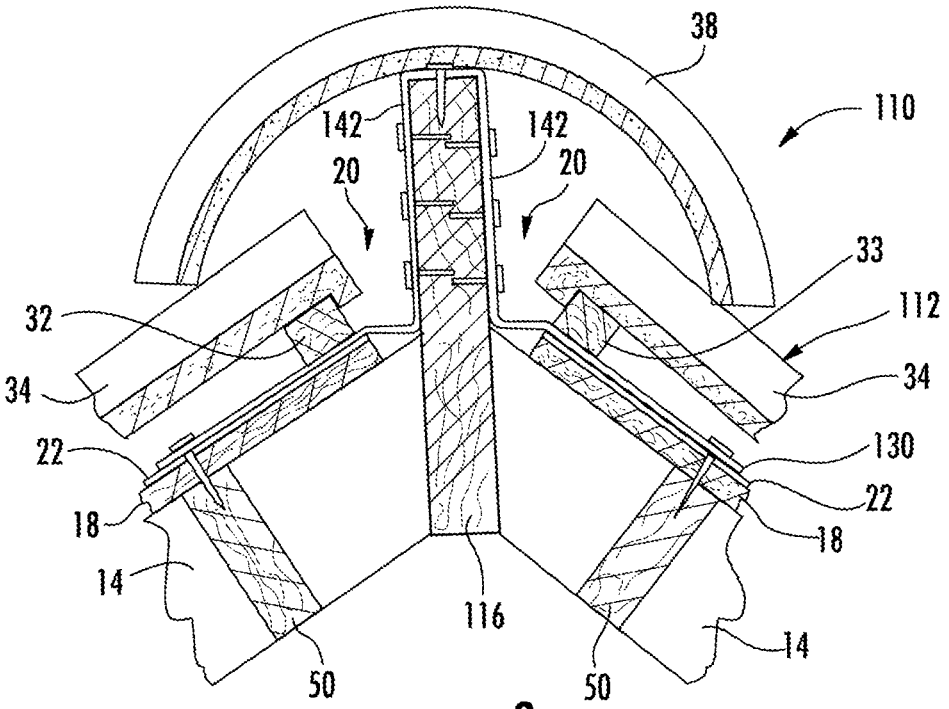
FIG. 3 is a cross-sectional view of the second embodiment of a shear tie system for a vented roof ridge with a shear tie strap in accordance with the present invention.

Referring now to FIG. 3, another embodiment of the shear tie system for a ventilated roof ridge 110 is shown. Here the roof 112 is also a tile roof and is similar to the roof 12 described in connection with the first embodiment of the invention. Accordingly, the same element numbers have been used for the same components. In this case, in place of the ridge beam 16 which required the ridge pole extension 36, a one piece ridge beam 116 is utilized which is designed to allow direct attachment of the cap tile 38 to the ridge beam 116. In order to accommodate this, the shear tie strap 130 has an extended cross straps indicated at 142 which can be formed around and over the top of the ridge beam 116. These can be held in place with nails or screws as indicated. The remainder of the shear tie system 110 is similar to the shear tie system 10.

Figure 4:
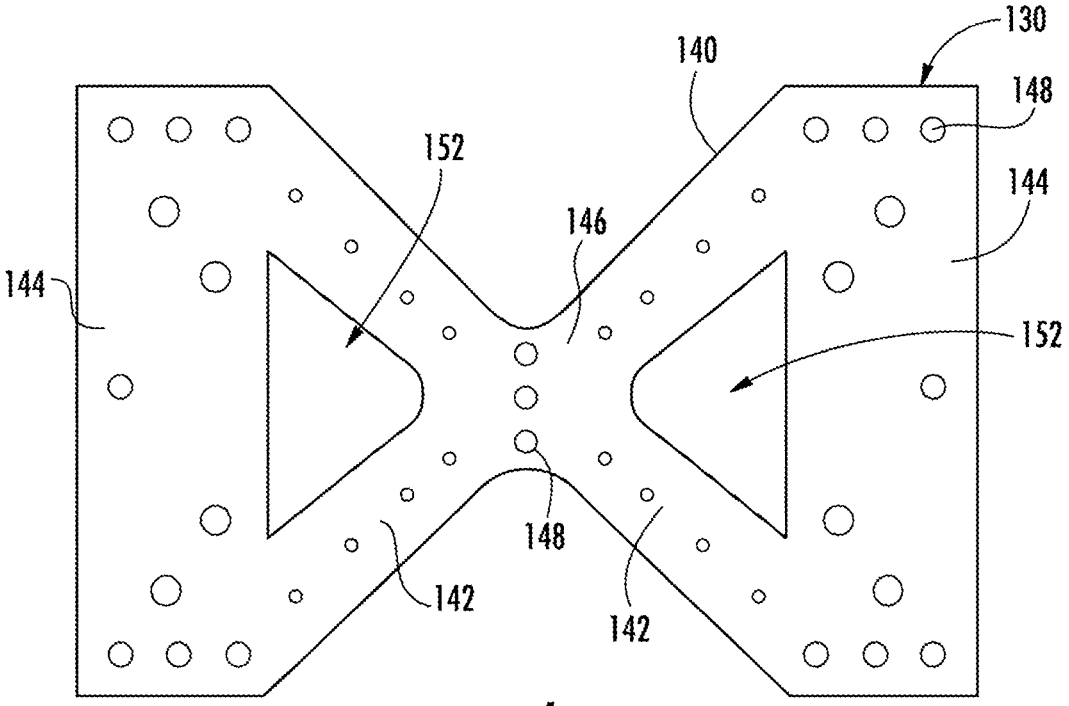
FIG. 4 is a plan view of an alternate embodiment of the shear tie strap.

Referring now to FIG. 4, an alternate embodiment of the shear tie strap 130 is shown. Here the cross straps 142 can have an extended length in order to be used in connection with the roof system 110 shown in FIG. 3. Nailer strip ends 144 provided at the ends of the straps 142. Additionally, the center nailer strip 146 is provided for connection to the roof ridge beam. Preformed holes 148 are also provided in order to allow for easier installation of nails or screws in order to hold the shear tie strap in position. Openings 152 are also provided in order to minimize blockage of the gaps or slots 20 provided in the sheathing 18 adjacent to the ridge beam for ventilation of the roof ridge.

Figure 5:
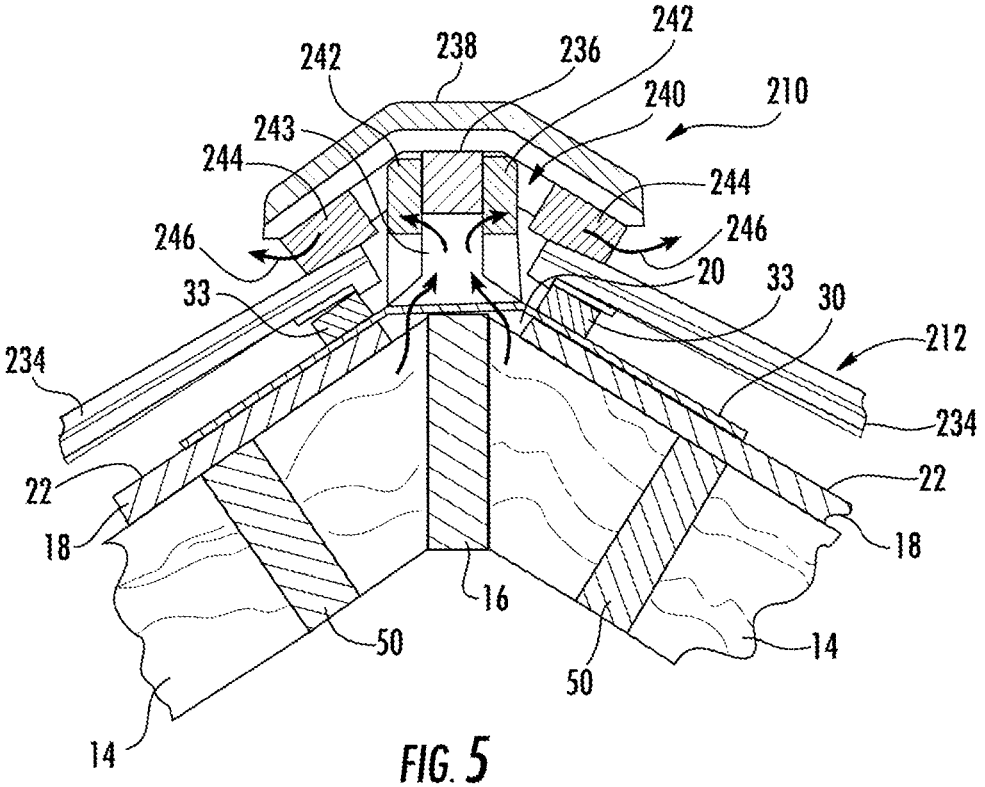
FIG. 5 is a cross-sectional view similar to FIG. 1 of a third embodiment of a shear tie system shown with a preferred roof ridge vent for tile roofs.

Referring now to FIG. 5, a further embodiment of a shear tie system 210 is shown that is similar to the embodiment 10 discussed above. In this case, the roof structure is the same and the shear tie strap 30 is installed over the sheathing 18 and nailed to the ridge beam 16 as well as the blocking 50 as shown. A roof ridge vent 240 in accordance with U.S. 2008/0318516 is then installed over the shear tie strap 30 along the ridge area of the roof. This roof ridge vent assembly 240 includes air permeable strips 242 supported by a sheet metal bracket 243 that is installed over the gaps or slots 20 between the sheathing 18 and the ridge beam 16. The sheet metal bracket 243 also supports the ridge pole extension 236 which provides a nailing strip for holding the cap tiles 238 in place. Additional vent material 244 is located between the cap tile 238 and the field tiles 234 which are supported via purlins 33 which are installed over the shear tie strap 30. The air flow is indicated by arrows 246. This arrangement shows the installation of the shear tie strap 30 in connection with a preferred roof ridge vent 240.

Figure 6:
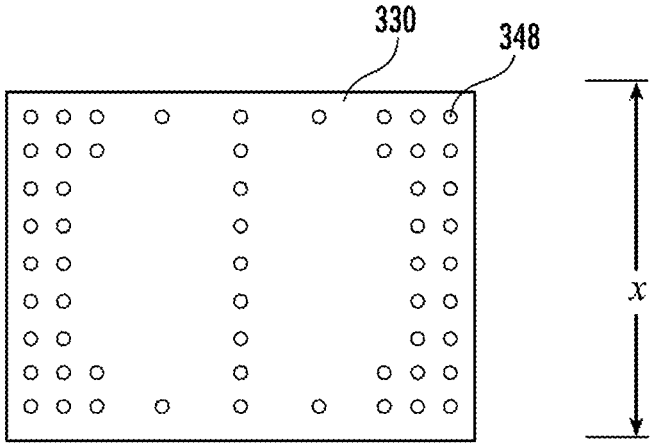
FIG. 6 is a top view of a shear tie strap for a non-ventilated roof application.

Referring to FIG. 6, a shear tie strap 330 for use in connection with non-ventilated roof ridges or for use in connection with roof ridge vents where the shear tie strap 330 is only installed on a limited number of adjacent pairs of rafters is shown. Here the shear tie strap 330 includes pre-formed holes 348 for connecting the shear tie strap 330 to the ridge beam as well as the rafters. The width X represents a sufficient size so that the shear tie strap 330 can span adjacent rafters, which are typically on 16 or 24 inch centers, resulting in the width dimension X typically being 17.5 inches or 25.5 inches. However, other sizes can be used depending upon a particular roof structure and associated standards.

Figure 7:
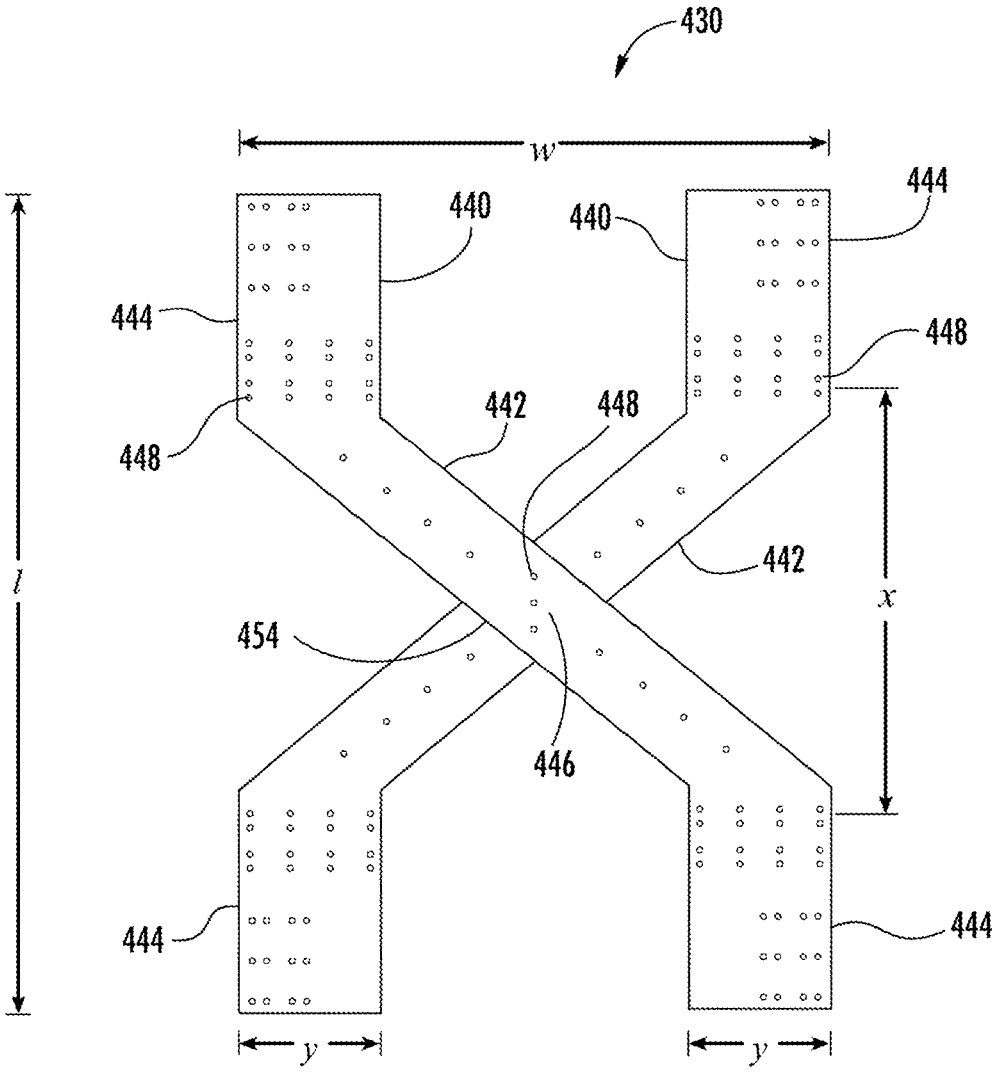
FIG. 7 is a top view of a shear tie strap according to another embodiment of the present invention.

Referring to FIG. 7, an embodiment of the shear tie strap 430 according to another embodiment of the present invention is depicted. The shear tie strap 430 comprises two sheet metal bodies 440, each comprising a cross strap 442 with nailer strips 444 provided at opposite ends of each cross strap 442. The sheet metal bodies 440 may be mirror images of each other as depicted, although other configurations may be used. The sheet metal bodies 440 are used as pairs, with one cross strap 442 overlapping over the other cross strap 442 at an intermediate region 454 wherein the overlapping intermediate regions 454 form at least part of a center nailing strip 446. In some embodiments, one or more preformed holes 448 are formed in the intermediate regions 454 such that the hole or holes align when the cross straps 442 overlap in a predetermined orientation.

When the cross straps 442 are overlapped in a predetermined orientation, the shear tie strap 430 has a width X of sufficient size so that at least some preformed holes 448 will be aligned with adjacent rafters such that nails or screws may be used to fasten the shear tie strap 430 to the rafters. Width X may be 16 inches or 14 inches for rafters placed on 16 inch or 24 inch centers, respectively. However, other sizes can be used depending upon a particular roof structure and associated standards. Preferably, the sheet metal bodies 440 are made of 16 gauge to 20 gauge sheet metal with a yield stress of 33 ksi. In one preferred arrangement, these were installed with lOd common nails, with at least 8 nails in in each of the nailer strips 444 at each end into the rafters. In an embodiment of the shear tie strap 430, X is 16 inches, the length of the shear tie strap 430 is 30.5 inches, its width (w) is 22 inches, and the width of the cross straps 442 is 3.25 inches at the intermediate regions 454, while the width (y) of the nailer strips 444 is 5.25 inches. In an embodiment of the shear tie strap 430, X is 24 inches, the length of the shear tie strap 430 is 38.5 inches, its width (w) is 22 inches, and the width of the cross straps 442 is 5.25 inches at the intermediate regions 454, while the width (y) of the nailer strips 444 is 5.25 inches. These dimensions are, however, exemplary. The skilled artisan would understand that the dimensions of a shear tie strap may be varied based on the ridge and roof design intended.

Figure 8A:
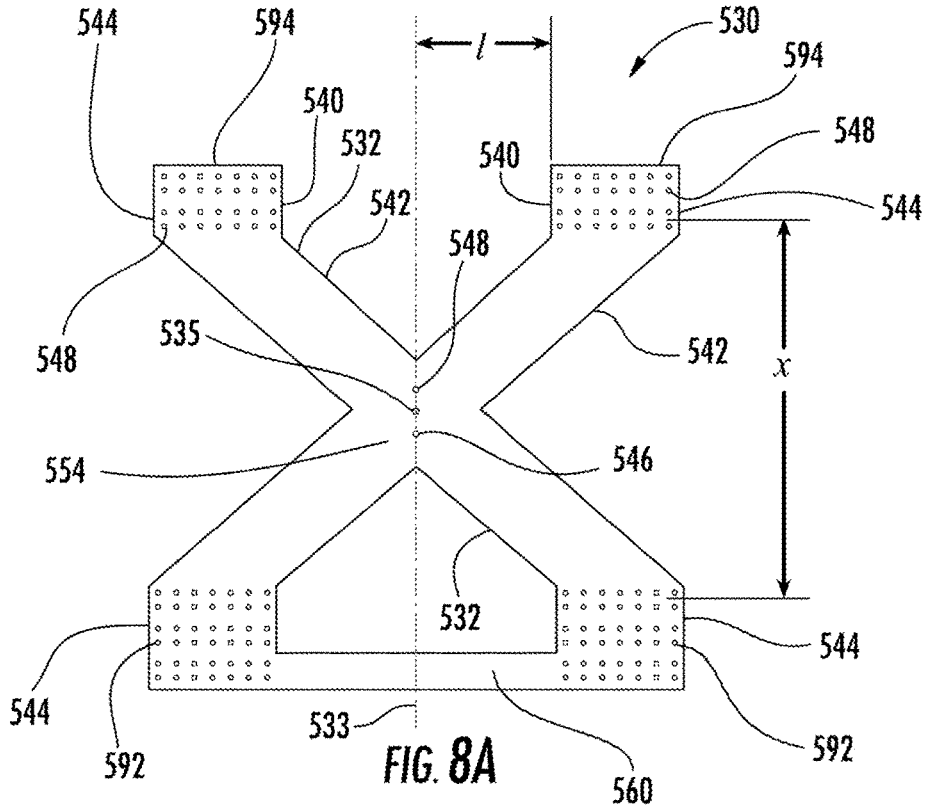
FIG. 8A is a top view of a shear tie strap according to another embodiment of the present invention.
Figure 8B:
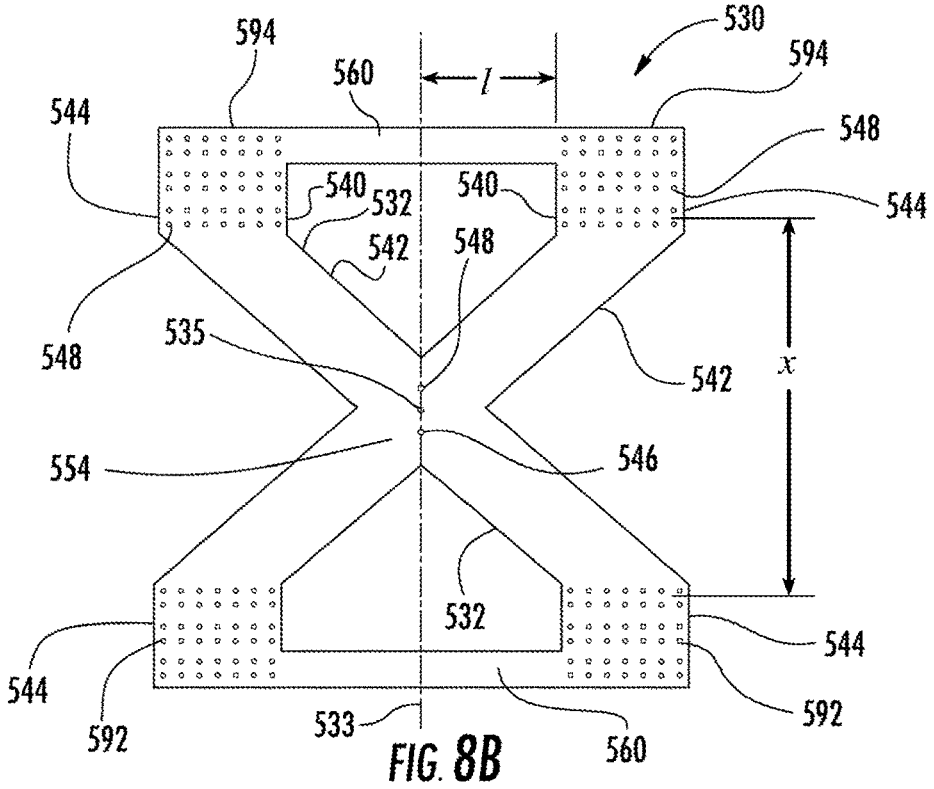
FIG. 8B is a top view of a shear tie strap according to another embodiment of the present invention.

Referring to FIGS. 8A and 8B, another embodiment of the shear tie strap 530 according to the present invention is depicted. Shear tie strap 530 may be a single integral unit, preferably of sheet metal. Alternatively, shear tie strap 530 may be multiple, assembled parts. The assembled parts may be fixed to one another by any suitable structure. For example, pre-drilled holes in separate elements may be aligned and the elements fastened by inserting a nail, screw, or any other suitable fastener. The shear tie strap 530 comprises sheet metal bodies 540, each comprising cross straps 542 with nailer strips 544 provided at opposite ends of each cross strap 542 (similar to 440 above with the overlap in the center region not being shown in FIGS. 8A and 8B). The sheet metal bodies 540 may be mirror images of each other about the longitudinal axis 533 as depicted, although other configurations may be used. The sheet metal bodies 540 may be used as pairs, with one cross strap 542 overlapping over the other cross strap 542 at an intermediate region 554 wherein the overlapping intermediate regions 554 form at least part of a center nailing strip 546 (similar to FIG. 7). When the shear tie strap 530 is a single, integral unit as illustrated in FIGS. 8A and 8B, the sheet metal bodies 540, and cross straps 542 are a single structure. In such an integral embodiment, the cross straps may be described as intersecting at intermediate regions.

The shear tie strap 530 may be connected to a ridge beam, the sheathing and the rafters on either side of the ridge beam. The two cross straps 542 may extend at an acute angle to the ridge beam, and include or be connected at down slope ends thereof to the nailer strips 544. The center nailer strip 546 may be implemented for attachment to the ridge beam. Longitudinal axis 533 in FIGS. 8A and 8B represents the position of the ridge beam when the shear tie strap 530 would be installed. The shear tie strap has a first longitudinal end 592 and a second longitudinal end 594. On the first longitudinal end 592, the ends of the cross straps 542 with nailer strips 544 are displaced in a first longitudinal direction, from the center 535 along longitudinal axis 533. On the second longitudinal end 594, the ends of the cross straps 542 with nailer strips 544 are displaced in a second longitudinal direction, from the center 535 along longitudinal axis 533. When installed, the first longitudinal end 592 would include the nailer strips 544, on cross straps 542, displaced from the center 535 in the first direction toward a first longitudinal end of the ridge beam. And the second longitudinal end 594 would include the nailer strips 544, on with cross straps 542, displaced from the center 535 in the second direction toward a second end of the ridge beam and opposite to the first direction.

Also illustrated in FIG. 8A is connecting strap 560. There may be a single connecting strap 560 connected at the ends of the cross straps 542 on the first longitudinal end 592 of the shear tie strap 530. FIG. 8A illustrates the connecting strap 560 associated with the nailer strips 544 at the ends of the cross straps 542. But a connecting strap may connect the cross straps 542 at the first longitudinal end 592 as illustrated or at an intermediate position between the ends of the cross straps 542 and the center 535. As illustrated in FIG. 8A, the connecting strap may span from one side of the shear tie strap to the other. A connecting strap may have a nailing strip(s) with pre-drilled holes, also as illustrated in FIG. 8A or 8B.

As shown in FIG. 8B, there may be a second connecting strap 560 connected at the ends of the cross straps 542 at the second longitudinal end 594 of the shear tie strap 530. As with the first connecting strap 560, the second connecting strap 592 may be associated with the nailer strips 544, or at an intermediate position between the ends of cross straps 542 and the center 535.

The connecting strap(s) 542 may be integral with at least one of the respective cross straps 542 connected, or the nailing strips 544 thereon. Alternatively, the connecting strap(s) 542 may be provided as an additional element and fixed to the respective ends 592, 594 of the shear tie strap 530.

The cross straps 542 and connecting straps 560 are referred to and illustrated with common reference characters and embodiments include cross straps, connecting straps, and other common elements having similar or identical dimensions. The skilled artisan will, however, recognize that variations of one cross strap, connecting strap, or other elements may be made.

In some embodiments, one or more preformed holes 548 are formed in the intermediate regions 554. In embodiments having separate sheet metal bodies, the hole or holes may align when the cross straps 542 overlap in a predetermined orientation.

When the cross straps 542 are overlapped in a predetermined orientation or when formed as an integral unit, the shear tie strap 530 has a width X of sufficient size so that at least some preformed holes 548 will be aligned with adjacent rafters such that nails or screws may be used to fasten the shear tie strap 530 to the rafters. Width X may be 16 inches, but may also be any other dimension that represents an on-center spacing of roof rafters. However, other sizes can be used depending upon a particular roof structure and associated standards. Preferably, the sheet metal bodies 540 are made of 16 gauge to 20 gauge sheet metal with a yield stress of 33 ksi. In one preferred arrangement, these may be installed with lOd common nails, with at least 8 nails in in each of the nailer strips 544 at each end into the rafters. The connecting strap 560 of FIG. 8A may be 1.5 inches in width. One or both of the connecting straps 560 of FIG. 8B may be 1.5 inches in width.

Figure 9A:
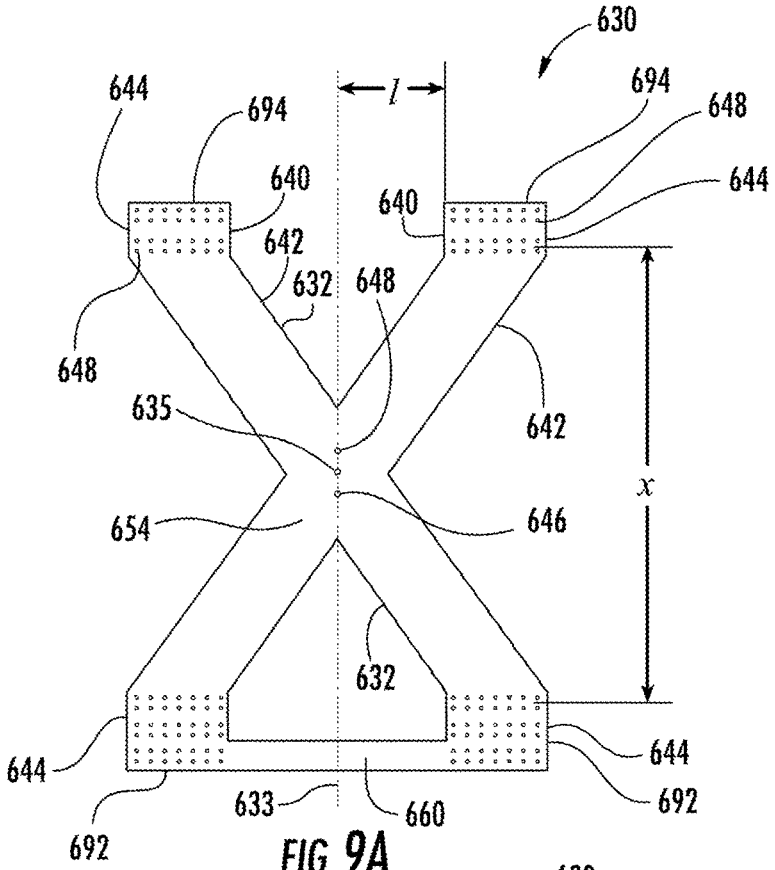
FIG. 9A is a top view of a shear tie strap according to another embodiment of the present invention.
Figure 9B:
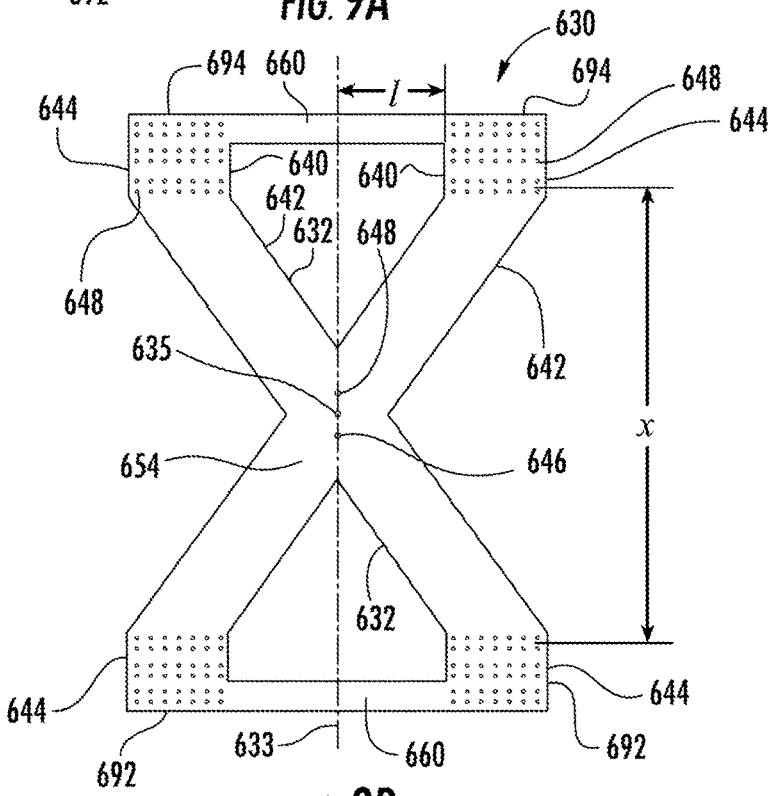
FIG. 9B is a top view of a shear tie strap according to another embodiment of the present invention.

Referring to FIGS. 9A and 9B, an embodiment of the shear tie strap 630 according to another embodiment of the present invention is depicted. Shear tie strap 630 may be a single integral unit, preferably of sheet metal. Alternatively, shear tie strap 630 may be multiple, assembled parts. The assembled parts may be fixed to one another by any suitable structure. For example, pre-drilled holes in separate elements may be aligned and the elements fastened by inserting a nail, screw, or any other suitable fastener. The shear tie strap 630 comprises sheet metal bodies 640, each comprising cross straps 642 with nailer strips 644 provided at opposite ends of each cross strap 642 (similar to 440 above with the overlap in the center region not being shown in FIGS. 9A and 9B). The sheet metal bodies 640 may be mirror images of each other as depicted, although other configurations may be used. The sheet metal bodies 640 may be used as pairs, with one cross strap 642 overlapping over the other cross strap 642 at an intermediate region 654 wherein the overlapping intermediate regions 654 form at least part of a center nailing strip 646. When the shear tie strap 630 is a single, integral unit as illustrated in FIGS. 9A and 9B, the sheet metal bodies 640, and cross straps 642 are a single structure. In such an integral embodiment, the cross straps may be described as intersecting at intermediate regions.

The shear tie strap 630 may be connected to a ridge beam, the sheathing and the rafters on either side of the ridge beam. The two cross straps 642 may extend at an acute angle to the ridge beam, and include or be connected at down slope ends thereof to the nailer strips 644. The center nailer strip 646 may be implemented for attachment to the ridge beam. Longitudinal axis 633 in FIGS. 9A and 9B represents the position of the ridge beam when the shear tie strap 630 would be installed. The shear tie strap has a first longitudinal end 692 and a second longitudinal end 694. On the first longitudinal end 692, the ends of the cross straps 642 with nailer strips 644 are displaced in a first longitudinal direction, from the center 635 along longitudinal axis 633. On the second longitudinal end 694, the ends of the cross straps 642 with nailer strips 644 are displaced in a second longitudinal direction, from the center 635 along longitudinal axis 633. When installed, the first longitudinal end 692 would include the nailer strips 644, on cross straps 642, displaced from the center 635 in the first direction toward a first longitudinal end of the ridge beam. And the second longitudinal end 694 would include nailer strips 644, on cross straps 642, displaced from the center 635 in the second direction toward a second end of the ridge beam and opposite to the first direction.

Also illustrated in FIG. 9A is connecting strap 660. There may be a single connecting strap 660 connected at the ends of the cross straps 642 on the first longitudinal end 692 of the shear tie strap 630. FIG. 9A illustrates the connecting strap 960 associated with the nailer strips 644 at the ends of the cross straps 642. But a connecting strap may connect the cross straps 642 at the first longitudinal end 692 as illustrated or at an intermediate position between the ends of the cross straps 642 and the center 635. As illustrated in FIG. 9A, the connecting strap may span from one side of the shear tie strap to the other. A connecting strap may have a nailing strip(s) with pre-drilled holes, also as illustrated in FIG. 9A or 9B.

As shown in FIG. 9B, there may be a second connecting strap 660 connected at the ends of the cross straps 642 at the second longitudinal end 694 of the shear tie strap 630. As with the first connecting strap 660, the second connecting strap 692 may be associated with the nailer strips 644, or at an intermediate position between the ends of cross straps 642 and the center 635.

The connecting strap(s) 642 may be integral with at least one of the respective cross straps 642 connected, or the nailing strips 644 thereon. Alternatively, the connecting strap(s) 642 may be provided as an additional element and fixed to the respective ends 692, 694 of the shear tie strap 630.

The cross straps 642 and connecting straps 660 are referred to and illustrated with common reference characters and embodiments include cross straps, connecting straps, and other common elements having similar or identical dimensions. The skilled artisan will recognize that variations of one cross strap, connecting strap, or other elements may be made.

In some embodiments, one or more preformed holes 648 are formed in the intermediate regions 654. In embodiments having separate sheet metal bodies, the hole or holes may align when the cross straps 642 overlap in a predetermined orientation.

When the cross straps 642 are overlapped in a predetermined orientation or when formed as an integral unit, the shear tie strap 630 has a width X of sufficient size so that at least some preformed holes 648 will be aligned with adjacent rafters such that nails or screws may be used to fasten the shear tie strap 630 to the rafters. Width X may be 24 inches, but may also be any other dimension that represents an on-center spacing of roof rafters. However, other sizes can be used depending upon a particular roof structure and associated standards. Preferably, the sheet metal bodies 640 are made of 16 gauge to 20 gauge sheet metal with a yield stress of 33 ksi. In one preferred arrangement, these may be installed with lOd common nails, with at least 8 nails in in each of the nailer strips 644 at each end into the rafters. The connecting strap 660 of FIG. 9A may be 1.5 inches in width. One or both of the connecting straps 660 of FIG. 9B may be 1.5 inches in width.

FIGS. 8A, 8B, 9A, and 9B also illustrate minimum distance 1, which is the distance from the center of the shear tie strap to the edge of the nailer strip proximal to the center. This distance may be set at any suitable distance. For example, the minimum distance 1 may be set so that the nailer strip overlaps a rafter with the appropriate offset from the end of the rafter. The minimum distance 1 may be 5¾ inches. The appropriate offset may be determined by the ridge vent gap size, the ridge beam width, the type of material in the rafter, local building codes, or the like. The skilled artisan would understand that variations in minimum distance 1, number of pre-drilled nail holes, length of cross straps, or any other dimension of a shear tie strap may be made to accommodate the type of roofing material, the material of the shear tie strap, local building codes, anticipated wind speed, anticipated seismic activity, building design, and anticipated shear forces due to the same.

The embodiments of FIGS. 7, 8A, 8B, 9A, and 9B may be included as the shear tie strap for any ridge vent. In particular, one of the shear tie strap 430, 530, or 630 may be provided as a shear tie strap in the embodiments of FIGS. 1, 3, and 5 in place of shear tie straps 30, 130, and 230, respectively. Adjustments in the shear tip strap 430, shear tie strap 530, or shear tie strap 630 or adjustments in the ridge vents of FIGS. 1, 3, and 5 to coordinate with such a change would be apparent to the skilled artisan. Embodiments include a roofing system with any of the roofing elements of FIG. 1, 3, or 5 in combination with one of the shear tie strap 430, the shear tie strap 530, or the shear tie strap 630.

Figure 10:
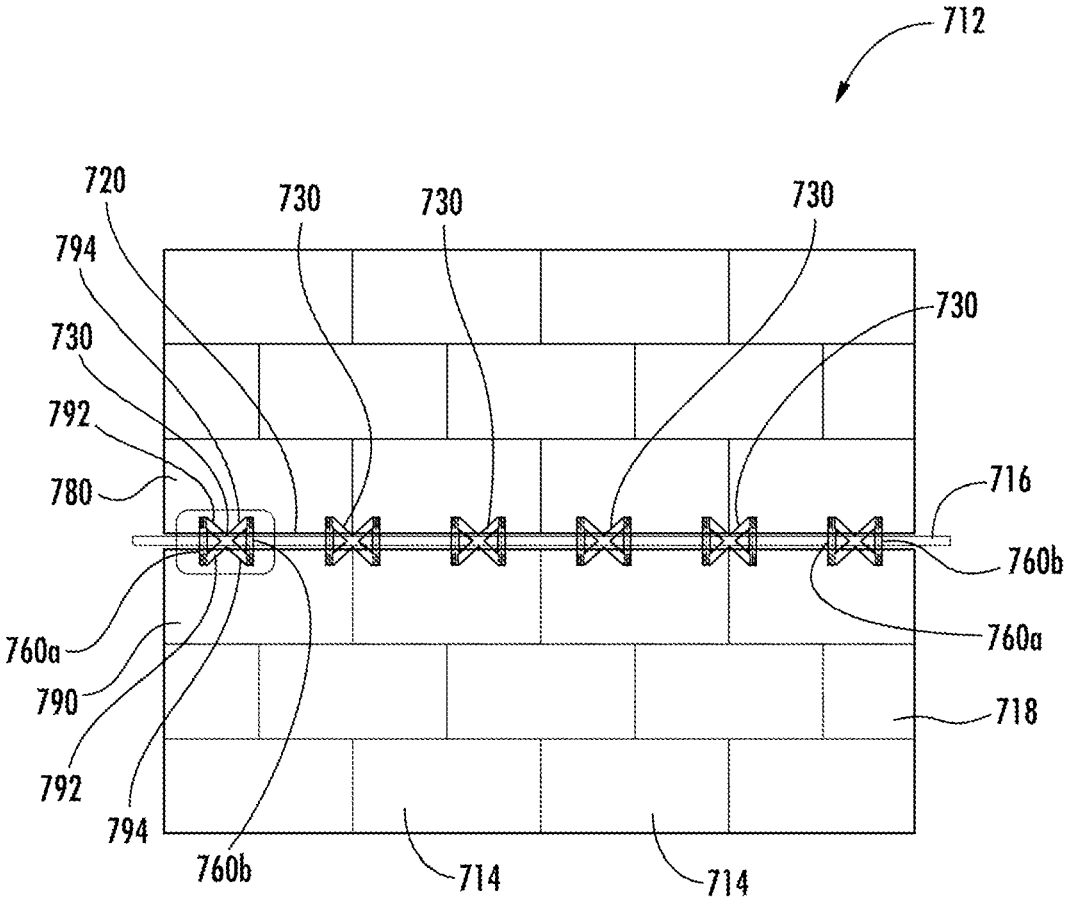
FIG. 10 is a top view of a roof with shear tie straps.

Referring to FIG. 10, a top view of a roof 712 is illustrated. The roof 712 includes gaps or slots 720 on both sides of a ridge beam 716 for venting. Shear tie straps 730 are illustrated spanning from one side of the roof 712 to the other, over the ridge beam 716. The shear tie straps 730 are similar in configuration to shear tie strap 530 or 630 in that each includes two connecting straps, 760*a* and 760*b*. Connecting strap 760*a* is positioned at a first longitudinal end 792 of shear tie strap 730 and spans from a first side 780 of the roof to a second side 790 of the roof. Connecting strap 760*b* is positioned at a second longitudinal end 794 of shear tie strap 730 and also spans from a first side 780 of the roof to a second side 790 of the roof. FIG. 10 illustrates one possible configuration for the placement of shear tie straps along the length of a roof. The skilled artisan would understand that the distance between each shear tie strap or the number of shear tie straps may be varied. The variation may be taken to conform to local ordinances or standards, anticipated wind speed, or anticipated seismic activity. The variation may be taken in consideration of local conditions and building characteristics that predict the amount of shear stress the building may be subjected to.

The skilled artisan would recognize that the manufacture of a shear tie strap may be accomplished by stamping or punching a single piece of material. Alternatively, multiple pieces, comprising any subsections of a shear tie strap, may be manufactured and then assembled to create the shear tie strap. Assembly may occur prior to or during installation on a roof. Assembly may include fixing any subsection of a shear tie strap to another with any suitable fixation element or fastener. Although preferred embodiments of a shear tie strap are described as including sheet metal, embodiments include a shear tie strap that is in whole or in part made of another material known in the art.

The skilled artisan would recognize the blockers or doublers made be added to a roof in any desired size or number to provide more anchor points for fasteners securing a shear tie strap to a roof. The blocker or doublers may be positioned to align with nailing strips. The skilled artisan would also recognize that a shear tie strap may be fastened with fasteners driven through the shear tie strap, through intermediate materials, and into rafters, blockers, or doublers. Embodiments include shear tie straps as illustrated or described but with fewer or no pre-drilled holes in nailing strips. The skilled artisan would recognize that holes could be made at any desired location for installation of a shear tie strap, or fasteners may be driven through the shear tie strap material.

A shear tie strap herein may be adapted to any roof. The roof may include tile, cedar, metal, or any other roofing material. The roof may be flat or have any pitch, including 12 on 12.

While the preferred embodiments have been described in detail, the invention is not limited to these specific embodiments which are considered as merely exemplary. Further modifications and extensions of the present invention may be developed and all such modifications are deemed to be within the scope of the present invention as defined by the appended claims.

What is claimed is:

1. A shear tie system for a vented roof ridge, comprising:

a ridge beam supported by rafters;

sheathing located on the rafters and a gap or slot between a top edge of the sheathing and the ridge beam in order to provide an air flow path for building ventilation;

a shear tie strap extending over the ridge beam and comprising a center, two cross straps that overlap or intersect each other at the center, a first longitudinal end displaced from the center of the shear tie strap in a first direction toward a first longitudinal end of the ridge beam, a second longitudinal end displaced from the center of the shear tie strap in a second direction toward a second end of the ridge beam and opposite to the first direction, a fastener strip on each cross strap on the first longitudinal end, and a fastener strip on each cross strap on the second longitudinal end, wherein at least one of the fastener strips comprises a hole; and a ridge vent installed over the shear tie strap and the gap or slot.

2. The shear tie system of claim 1, wherein the shear tie strap is attached to the sheathing by fasteners through the fastener strips.

3. The shear tie system of claim 2, wherein the center is attached to the ridge beam by a fastener through the center.

4. The shear tie system of claim 3, wherein the center further comprises a fastener strip comprising a hole through the shear tie strap and the fastener is installed through the hole.

5. The shear tie system of claim 1, wherein the shear tie strap has a width that is adapted to a spacing between adjacent rafters on the roof.

6. The shear tie system of claim 1, wherein the shear tie strap comprises a first sheet metal body and a second sheet metal body, each comprising one of the two cross straps, wherein the two cross straps overlap in an intermediate region such that the overlapping intermediate regions form at least part of a center fastener strip.

7. The shear tie system of claim 1, wherein the shear tie strap further comprises a first connecting strap extending over the ridge beam and connecting the cross straps on the first longitudinal end of the shear tie strap.

8. The shear tie system of claim 7, wherein the shear tie strap further comprises a second connecting strap extending over the ridge beam and connecting the cross straps on the second longitudinal end of the shear tie strap.

9. The shear tie system of claim 8, wherein the first connecting strap is associated with respective nailer strips on each of the cross straps at the first longitudinal end, and the second connecting strap is associated with respective fastener strips on each of the cross straps at the second longitudinal end.

10. The shear tie system of claim 9, wherein the first connecting strap includes nailer strips and the second connecting strap includes fastener strips.

11. The shear tie system of claim 1, wherein the a fastener strips on each cross strap on the first longitudinal end are at down slope ends of the two cross straps and are integral with the two cross straps, and the fastener strips on each cross strap on the second longitudinal end are at down slope ends of the two cross straps and are integral with the two cross straps.

* * * * *